US005426443A

United States Patent [19]

Jenness, Jr.

[11] Patent Number: 5,426,443

[45] Date of Patent: Jun. 20, 1995

[54] DIELECTRIC-SUPPORTED REFLECTOR SYSTEM

[76] Inventor: James R. Jenness, Jr., 1653 Dogwood Cir., State College, Pa. 16803

[21] Appl. No.: 182,778

[22] Filed: Jan. 18, 1994

[51] Int. Cl.[6] ..... H01Q 19/14

[52] U.S. Cl. ..... 343/781 P; 343/781 R; 343/912

[58] Field of Search ..... 343/781 P, 781 CA, 781 R, 343/785, 786, 912

[56] References Cited

U.S. PATENT DOCUMENTS

| | | | |
|---|---|---|---|
| 3,611,396 | 10/1971 | Jones | 343/786 |
| 4,188,632 | 2/1980 | Knox | 343/781 P |
| 4,482,513 | 11/1984 | Auletti . | |
| 4,636,801 | 1/1987 | Myer . | |
| 4,783,665 | 11/1988 | Lier et al. | 343/786 |
| 5,057,844 | 10/1991 | Rothstein . | |

FOREIGN PATENT DOCUMENTS

| | | | |
|---|---|---|---|
| 0122508 | 9/1981 | Japan | 343/781 CA |
| 0170502 | 3/1960 | Sweden | 343/781 CA |

*Primary Examiner*—Donald Hajec

*Assistant Examiner*—Tho G. Phan

[57] ABSTRACT

Dielectric body 20 has a back surface 18, a surface of revolution about an axis 9-9. Back surface 18 has the form of a primary reflector of an antenna for transmitting or receiving microwave or millimeter wave electromagnetic radiation. A layer 15 of electrically conductive material is in contact with back surface 18. Dielectric body 20 also has a dome 23, a coaxial surface of revolution. A layer 25 of electrically conductive material is in contact with dome 23. A horn 40 fits on a protrusion 17 of dielectric body 20. Protrusion 17 aligns horn 40 on axis 9-9. The axial dimension of dielectric body 20 maintains the proper spacing between horn 40, conductive layer 25, and conductive layer 15 to enable the assembly to function as an antenna system. In the configuration shown, conductive layer 15, in contact with surface 18, forms a paraboloidal primary reflector. Conductive layer 25, in contact with dome 23, forms the concave ellipsoidal secondary reflector of a Gregorian antenna system. The system can also be configured as a Newtonian system with a flat secondary reflector or a Cassegrainian system with a convex hyperboloidal secondary reflector. The preferred material for body 20 is a foamed polymer with a low dielectric constant.

9 Claims, 8 Drawing Sheets

DIELECTRIC-SUPPORTED REFLECTOR SYSTEM

BACKGROUND OF THE INVENTION

1. Field of the Invention

The present invention relates to novel reflector structures in general, and in particular to antenna systems for microwave and millimeter wave electromagnetic radiation.

2. Description of the Prior Art

When a reflector assembly operates as a transmitting antenna, a radiation feed, horn, or other component associated with an electromagnetic wave transmitting device is placed on the axis of the assembly. In some systems such a component is placed at the focus of a single reflector, and projects electromagnetic waves toward the reflector. In other systems it projects waves toward a secondary reflector that re-directs them to a primary reflector. The primary reflector is a concave paraboloid; it collimates the electromagnetic waves coming from the transmitting device or secondary reflector. The secondary reflector in a Gregorian system is a coaxial concave ellipsoid. In a Newtonian system it is flat. In a Cassegrainian system it is a coaxial convex hyperboloid.

When the assembly operates as a receiving antenna, the primary reflector collects incoming electromagnetic waves. It directs them to a component such as a horn associated with an electromagnetic wave receiving device, or to a secondary reflector that redirects them to such a component.

A secondary reflector displaces the effective focus of an antenna back toward the primary reflector. This makes it possible to mount an electromagnetic wave transmitting or receiving device near the primary reflector, reducing the axial dimension of the assembly. A Cassegrainian system is the most compact configuration. However, the concave ellipsoidal secondary reflector of a Gregorian system is easier to fabricate than the convex hyperboloidal secondary reflector of a Cassegrainian system. The flat secondary reflector of a Newtonian system is the simplest. Foamed polymers are ideal materials for fabrication of such components.

Auletti (U.S. Pat. No. 4,482,513) forms microwave lenses of foam. He brings the effective dielectric constant to the desired value by mixing aluminum flakes in foam resin before pouring it into a lens mold. His invention is for refracting antennas rather than reflecting antennas.

Myer (U.S. Pat. No. 4,636,801) takes advantage of the high strength-to-weight ratio of a foamed polymer material, but does not make use of its low dielectric constant. His primary reflector is a metal layer bonded to a concave paraboloidal surface on a foam body. The foam is behind the reflector; the reflecting surface is exposed. A secondary reflector also has an exposed reflecting surface with foam behind a metal layer. The secondary reflector is supported by spider legs attached to the foam body of the primary reflector. Major portions of Myer's description and claims are devoted to the spider legs. Fabrication of the assembly requires skilled hand labor to achieve precise placement of the spider legs and secondary reflector relative to the primary reflector. After the spider legs and secondary reflector are set in place, the assembly must remain undisturbed for a period of time to allow an adhesive to form a bond between the parts.

Rothstein (U.S. Pat. No. 5,057,844) recognizes the benefit of protecting a metal antenna with a material of low dielectric constant. He sandwiches a flat strip antenna between flat pieces of polystyrene foam. The foam pieces do not shape the antenna; they merely enclose it for protection from a corrosive environment.

Knox (U.S. Pat. No. 4,188,632) shows a secondary reflector or splash plate attached to a dielectric body in front of a waveguide. This subassembly is only part of a larger system that includes a primary reflector which Knox does not show. The splash plate blocks a portion of the primary reflector; a small splash plate is desirable. The dielectric body acts as a lens to change the directions of waves reflected by the splash plate, making possible the use of a smaller splash plate. A foam with a low dielectric constant would require a larger splash plate, defeating Knox's purpose. Knox shows a rod-like extension from the dielectric body, continuing with a tapered portion. It is a long slender member deeply inserted in a tightly-fitting waveguide. Its purpose is to match the impedance from air in the waveguide to the external body with a higher dielectric constant. Care is required to avoid breaking off this member in the process of inserting it into the waveguide. This does not facilitate rapid assembly in a manufacturing operation. Regardless of the speed of assembling the waveguide/-splash plate subassembly, Knox's dielectric extension does not key the location of the waveguide/splash plate subassembly relative to a primary reflector.

Iida (Japanese Patent No. 56-122,508) describes a horn/waveguide subassembly for mounting in front of a primary reflector. Iida does not show the primary reflector or mechanical keys for locating the subassembly relative to it. Iida's subassembly performs a function similar to that of Knox. Iida shows a dielectric wave director that serves as an extension of a horn. This dielectric body directs waves by internal reflection, confining them within the dielectric in transit from the metal horn to a convex subreflector. The convex subreflector changes the wavefront directions to enable reflected waves to pass through the dielectric/air interface at angles away from the critical angle for total internal reflection. Total internal reflection requires a dielectric constant greater than that of air, so a foam dielectric would not serve Iida's purpose.

Jones (U.S. Pat. No. 3,611,396) shows a foam body in the form of a horn with corrugated walls and a flat septum between top and bottom sections. The surfaces are plated with metal by a complex process, the subject of another patent application. The corrugated surfaces are not compatible with rapid attachment of layers of low-cost electrically conducting materials such as foils or wire fabrics.

Lier et al. (U.S. Pat. No. 4,783,665) describe dielectric horns that serve mainly to support metal grid structures in front of metal horns. Such a modified horn functions in a manner similar to that of a corrugated horn.

Berg (Swedish Patent No. 170,502) shows foam between the concave primary reflector and the convex secondary reflector of a Cassegrainian antenna. The foam does not extend into a horn at the center of the primary reflector. The horn is attached to the primary reflector. The reflectors are pre-formed metal shells. Berg does not disclose a fabrication process, but the assembly shown in his single drawing could be fabricated by foaming in place, holding the primary and secondary reflectors in their required positions relative to each other and allowing a foaming resin to expand between them. In this process the foam is shaped by the pre-formed reflector shells. Berg does not teach the lamination of metal foils, electrically conducting polymer films, wire screens, or electrically conducting fabrics on a pre-formed foam body.

SUMMARY OF THE INVENTION

The principal component of this invention is a body of dielectric foam material with one or more external surfaces in the form of antenna reflectors. When such a surface is covered by a layer of electrically conducting material, it forms a microwave reflector analogous to a back-surface mirror. The surface of the foam body shapes and supports the reflector thus formed, and occupies space between it and other antenna components. No other structure is required to hold such a reflector at its proper location relative to another reflector and an electromagnetic wave transmitting or receiving device. The foam body has low dielectric loss and a low dielectric constant, so there is very little change in the amplitude or direction of electromagnetic waves passing through it. The geometry of the antenna system differs very little from that of a conventional system with air in front of the primary reflector. No spider legs or other dielectric discontinuities clutter the primary reflector aperture. The form and dimensions of the dielectric body maintain the required positions of a primary reflector, secondary reflector, and electromagnetic wave transmitting or receiving device relative to each other.

The advantages of the invention are light weight and economy of manufacture. The dielectric body can be molded at low cost. Its size and shape ensure precise placement of the reflectors and a horn associated with an electromagnetic wave transmitting or receiving device in contact with its external surfaces. No special skills are required for assembly.

DESCRIPTION OF THE PREFERRED EMBODIMENTS

Figure 1:
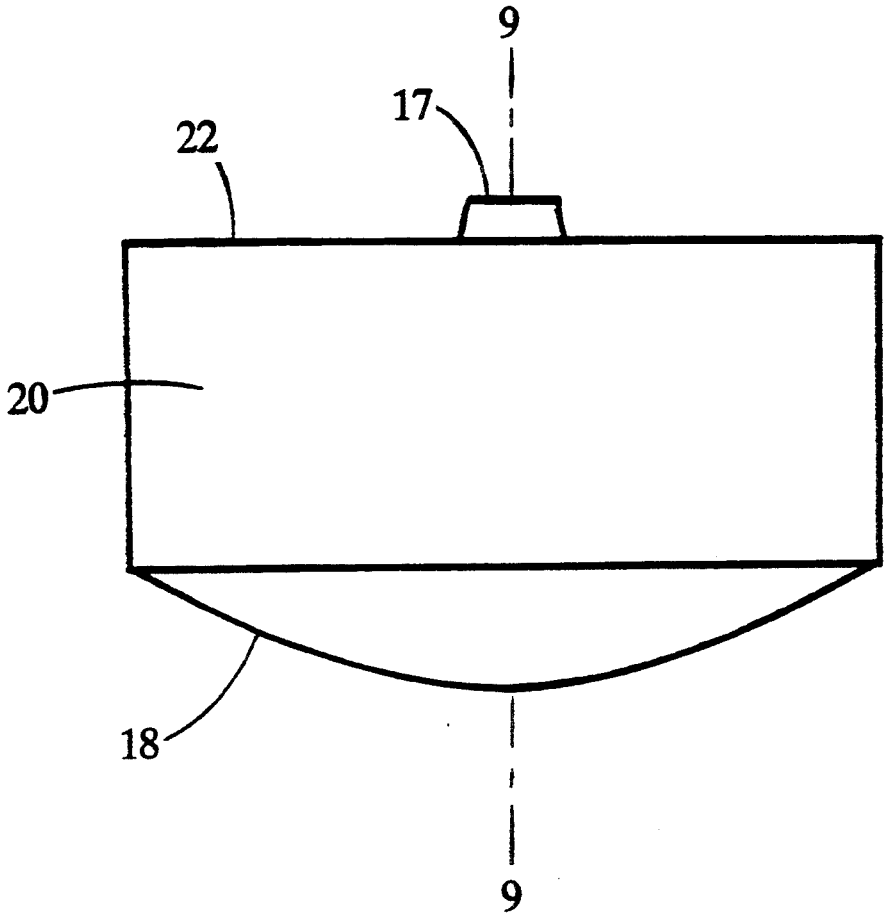
FIG. 1 is a side view of a dielectric body with a single reflector surface

FIG. 1 shows a side view of a dielectric body 20. Its back surface 18 is a paraboloid of revolution about an axis 9-9. A front surface 22 is flat and orthogonal to axis 9-9. An axially symmetric protrusion 17 extends beyond surface 22; its axis coincides with axis 9-9 of paraboloidal surface 18.

Figure 2:
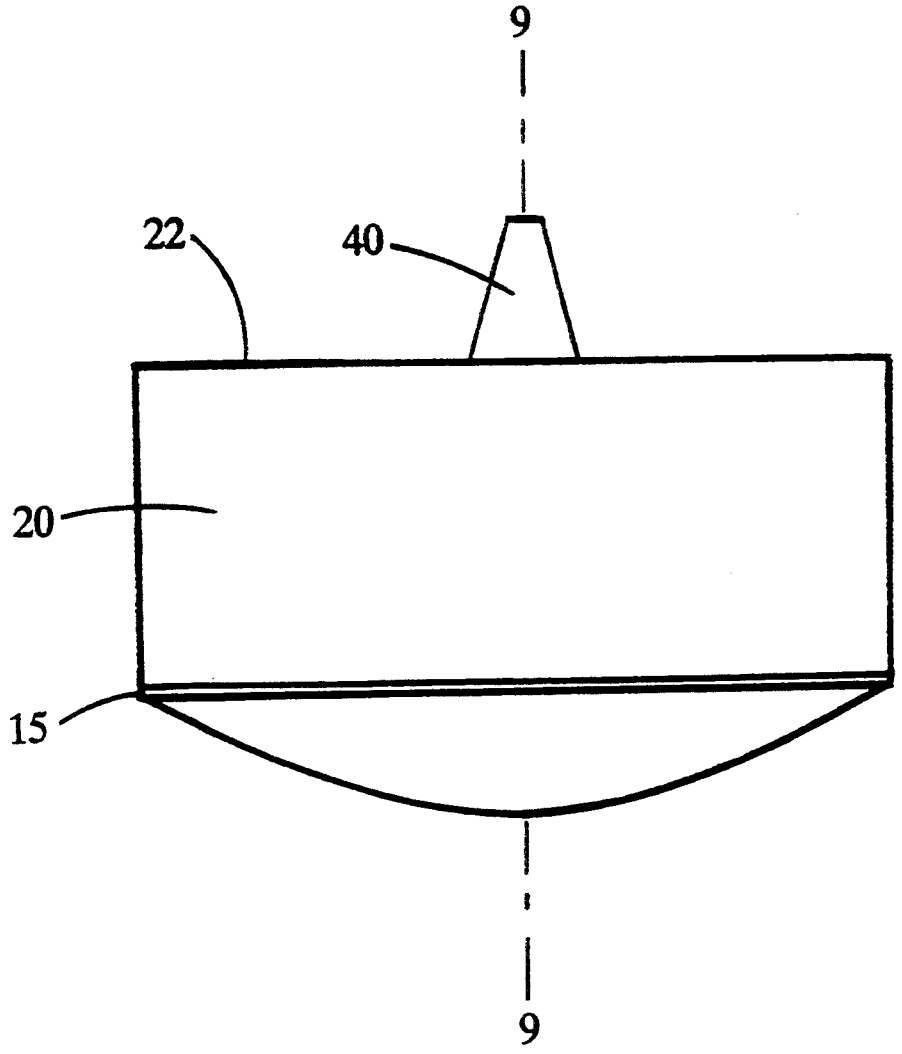
FIG. 2 shows the body of FIG. 1 with attachments.

FIG. 2 shows body 20 of FIG. 1 with a layer 15 of electrically conducting material attached, forming a reflector. A horn 40 associated with a device for transmitting or receiving microwave or millimeter wave electromagnetic radiation rests on front surface 22, centered by protrusion 17 of FIG. 1. The axis of horn 40 in FIG. 2 coincides with axis 9-9 of paraboloidal surface 18 in FIG. 1. The axial dimension of body 20 places horn 40 at a specified distance from conducting layer 15.

Figure 3:
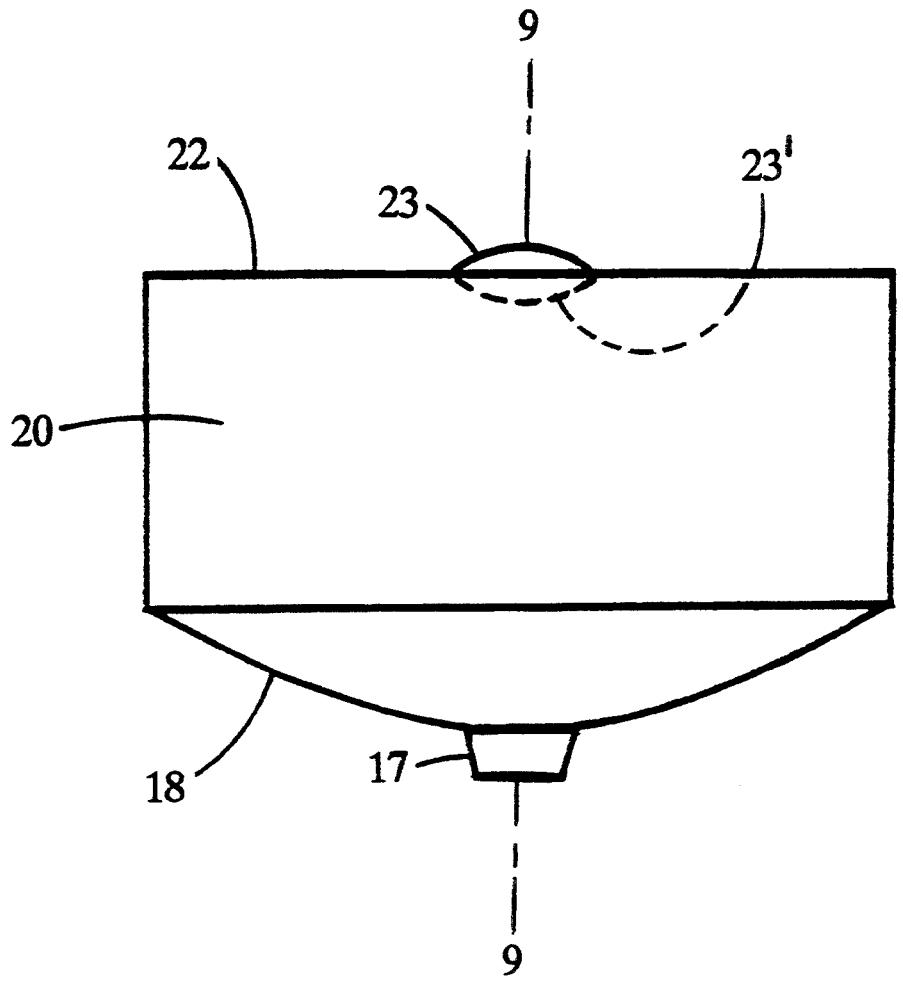
FIG. 3 is a side view of a dielectric body with two reflector surfaces.

FIG. 3 shows a side view of a dielectric body 20 with two reflector surfaces. Its back surface 18 is a paraboloid of revolution about an axis 9-9. A coaxial protrusion 17 extends beyond paraboloidal surface 18. An upper surface 22 is flat and orthogonal to axis 9-9. A dome 23 protruding above flat surface 22 is a surface of revolution about axis 9-9. For a Gregorian antenna system dome 23 is an ellipsoid. The axial dimension of body 20 places dome 23 at a specified distance from surface 18 and protrusion 17.

Figure 4:
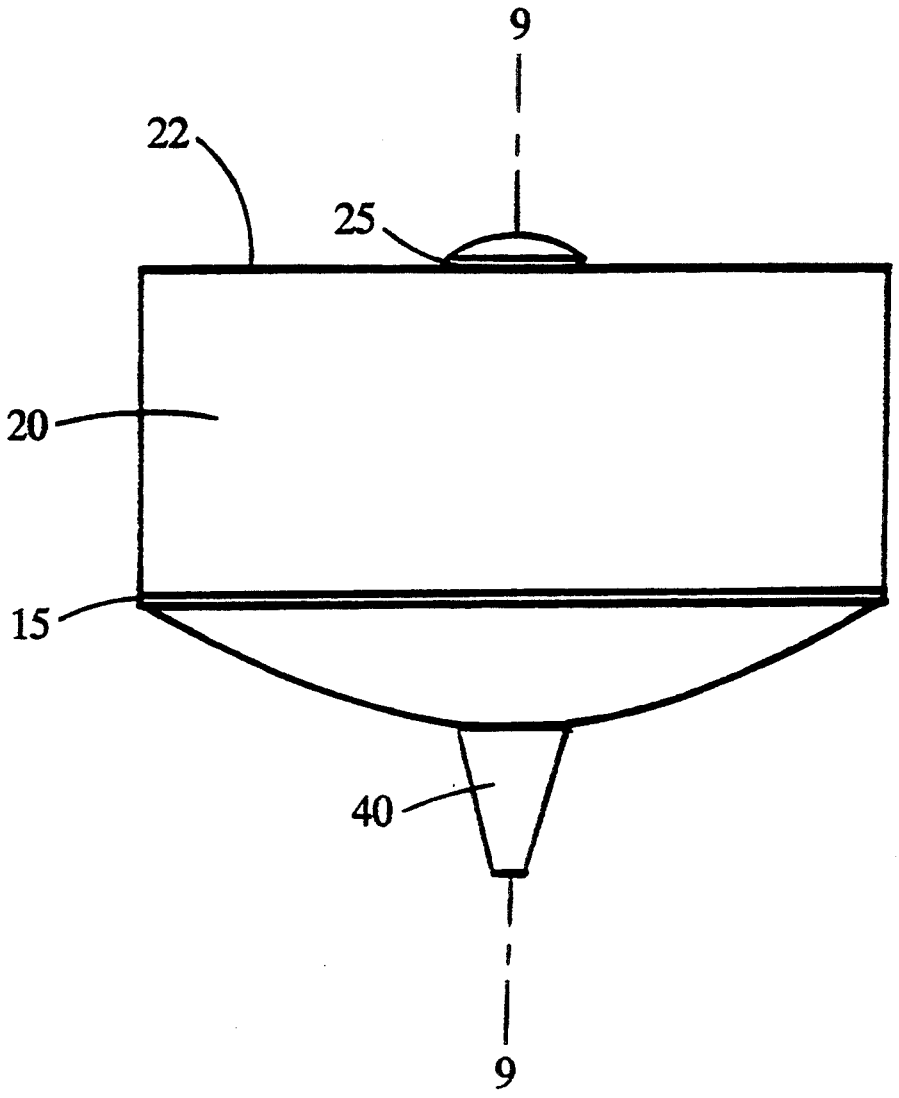
FIG. 4 shows the body of FIG. 3 with attachments.

FIG. 4 shows body 20 of FIG. 3 with a layer 15 of electrically conducting material attached, forming a primary reflector. A second layer 25 of conducting material is attached, forming a secondary reflector. A horn 40 associated with a device for transmitting or receiving microwave or millimeter wave electromagnetic radiation fits over protrusion 17 of FIG. 3. The axial dimension of body 20 places horn 40 and conducting layer 15 at specified distances from the secondary reflector formed by conducting layer 25.

Figure 5:
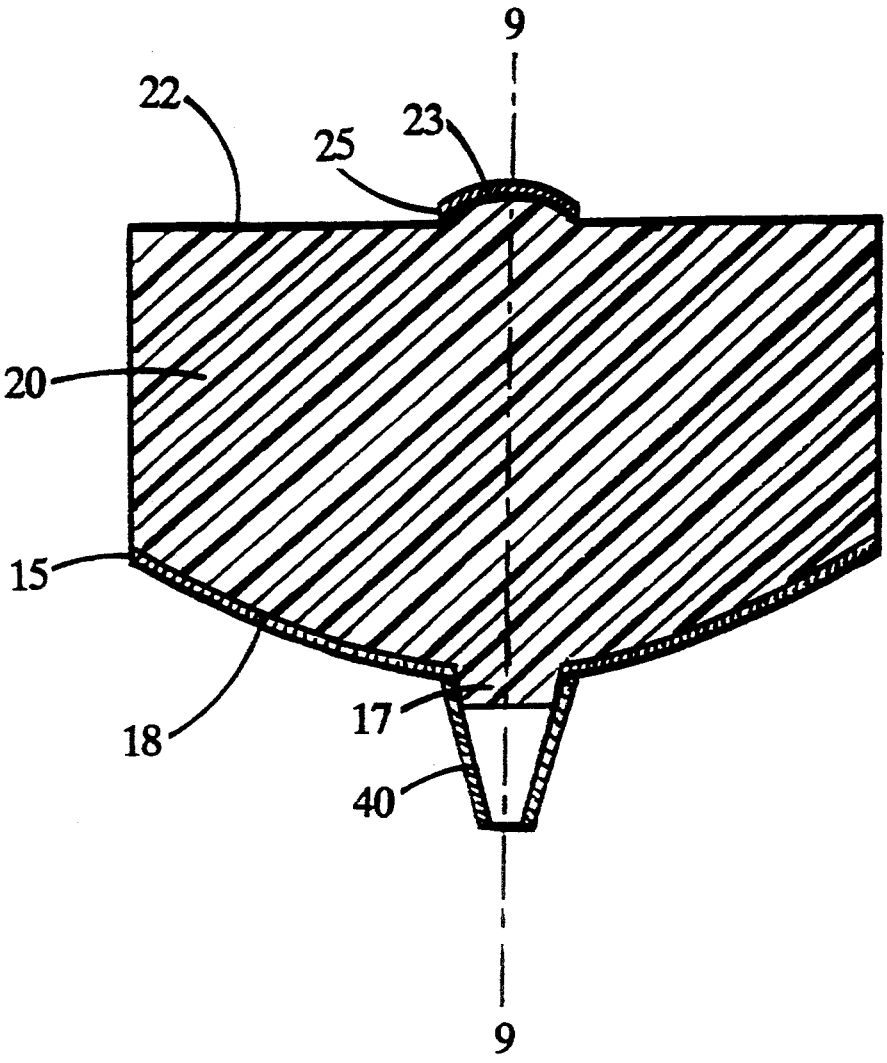
FIG. 5 is a cross-section through an antenna formed by a horn and electrically conducting layers attached to the dielectric body of FIG. 3.

FIG. 5 shows an axial cross section through FIG. 4 with a horn 40 on protrusion 17, which aligns it on axis 9-9. An electrically conducting layer 15 covers surface 18, forming a primary reflector. A second conducting layer 25 covers dome 23, forming a secondary reflector. The axial dimension of dielectric body 20 sets conducting layer 25 at a specified distance from horn 40 and conducting layer 15.

Figure 6:
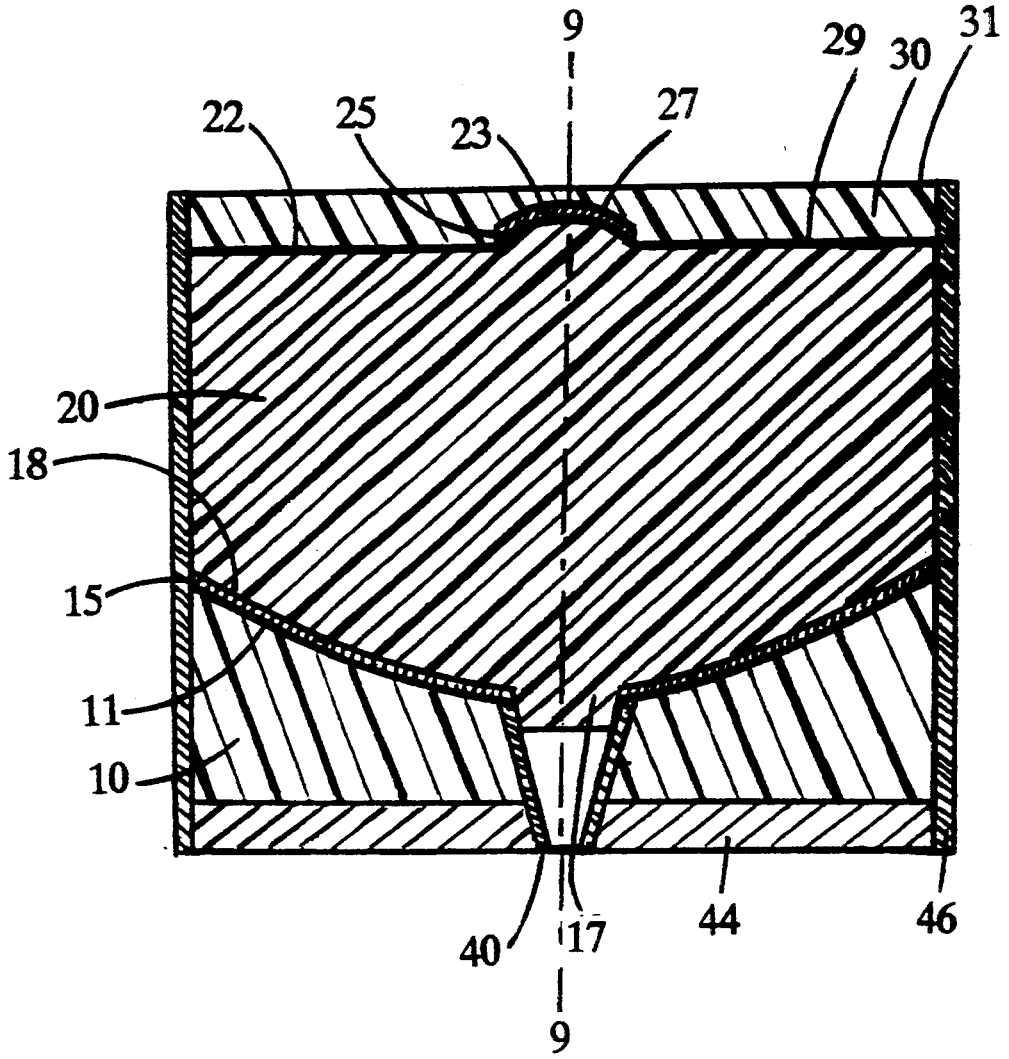
FIG. 6 is a cross-section showing the antenna assembly of FIG. 5 enclosed by protective structures.

FIG. 6 shows the assembly of FIG. 5 reinforced by a rear body 10 with a concave surface 11 mating with the convex surface of a conducting layer 15 on surface 18 of dielectric body 20. A dielectric cover 30 encloses surface 22 of body 20 and conducting layer 25 on dome 23. Cover 30 has an upper surface 31, a lower surface 29, and a concave depression 27 conforming to the convex surface of conducting layer 25 on dome 23. Rear body 10 and horn 40 are secured to a back plate 44. A protective shell 46 encloses the assembly. An electromagnetic wave transmitting or receiving device can be mounted behind plate 44, or horn 40 can be coupled to a waveguide leading to a transmitting or receiving device farther from the reflector assembly.

Figure 7:
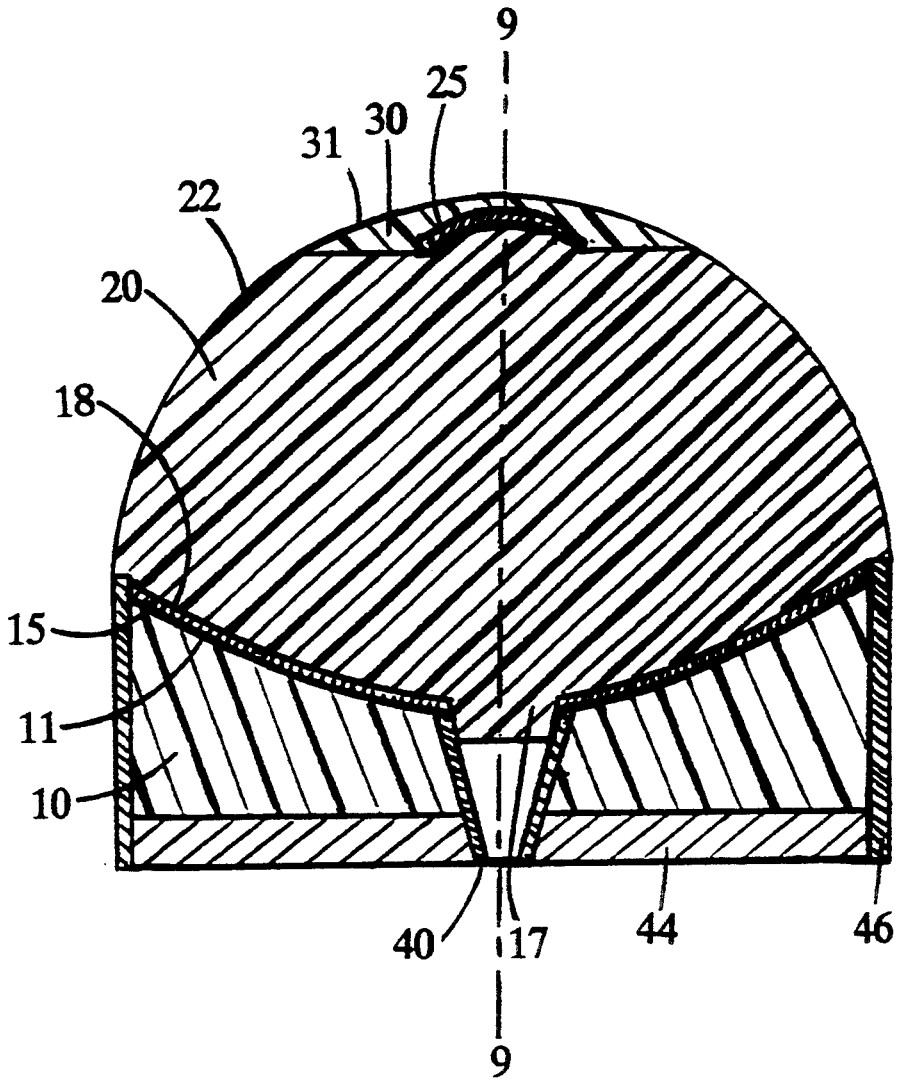
FIG. 7 is a cross-section through an antenna assembly of modified form.

The upper surface of dielectric body 20 need not be flat. It can be any of a wide variety of surfaces of revolution about axis 9-9. As an example, FIG. 7 shows dielectric body 20 with a convex outer surface 22. Cover 30 has an outer surface 31 that is a continuation of surface 22. In the most general case both the primary and secondary reflectors can have empirically designed surfaces of revolution not described by conic-section equations. Their curvature can compensate for any lens effect that may result if outer surface 22 of dielectric body 20 and contiguous outer surface 31 of cover 30 form a non-flat surface of revolution such as that in FIG. 7. Of course some foamed polymers have a dielectric constant as low as 1.04, corresponding to a refractive index of 1.02. Such materials have very little refractive effect on microwave and millimeter wave radiation. If such materials are used for body 20 and cover 30 in FIG. 7, the forms of the reflector surfaces will be the same as those in a conventional open antenna system. A further advantage of foamed polymer materials is their low density; antenna structures constructed of such materials will be light in weight.

Figure 8:
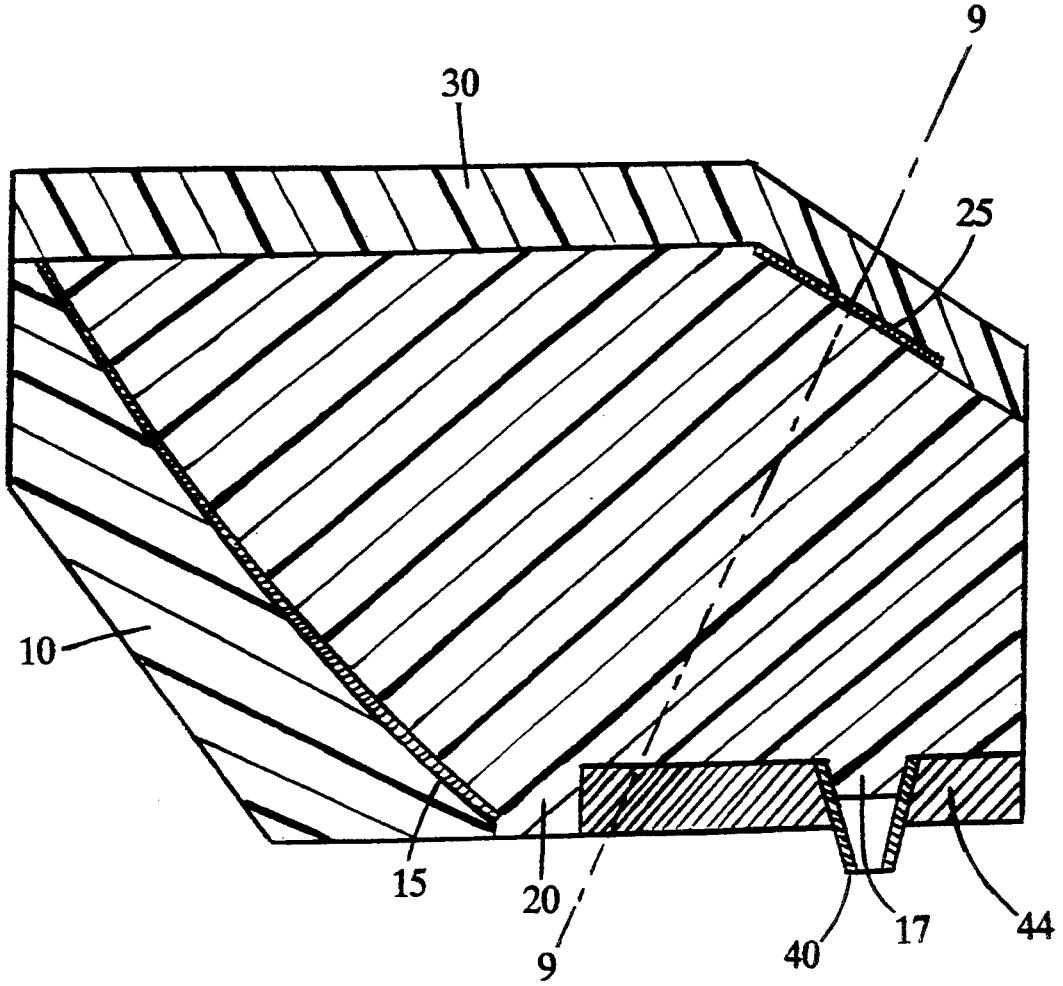
FIG. 8 is s cross-section through an off-axis antenna assembly.

The configuration need not be symmetric; the axis of the antenna system can lie outside the primary reflector surface. An electromagnetic wave transmitting or receiving device or a secondary reflector need not obstruct the profile of an off-axis primary reflector. For example FIG. 8 shows the mating surfaces of rear body 10 and dielectric body 20 as off-axis paraboloids. Antenna axis 9-9 is outside the periphery of the primary reflector formed by conducting layer 15. Horn 40 and the secondary reflector formed by conducting layer 25 are at side locations where they do not block the aperture of the primary reflector. In a Newtonian system, the flat secondary reflector formed by conducting layer 25 need not be orthogonal to antenna axis 9-9. Horn 40 mating with protrusion 17 is mounted on a plate 44. An electromagnetic wave transmitting device or receiving device can also be secured to plate 44.

Even if the dielectric constant is significant, there will be no change in the direction of electromagnetic waves if front surface 22 of body 20 and surfaces 29 and 31 of cover 30 in FIG. 6 are flat, parallel, and orthogonal to axis 9-9. Cover 30 will cancel surface reflections if it has a thickness of one quarter wavelength and a dielectric constant equal to the square root of the dielectric constant of body 20. The waves travel in the same directions as those in an antenna with air in the space occupied by body 20 and cover 30.

Whether or not the dielectric constant is significantly different from that of air, the external surface in front of the antenna can be curved as shown in FIG. 7. A curved convex surface will have lower wind resistance and will shed rain and snow better than a flat surface. This is important for roof-mounted antennas. Also, the convex outer surface of an assembly such at that shown in FIG. 7 can be provided with a reflection-reducing cover of tailored thickness and dielectric constant.

FIGS. 3, 4, 5, 6, and 7 show dome 23 of body 20 configured as an ellipsoid for a Gregorian antenna system. Alternatively, body 20 can have a concave coaxial hyperboloidal depression 23, (see FIG. 3); conducting layer 25 will then form the convex hyperboloidal secondary reflector of a Cassegrainian antenna system. With a flat front surface on body 20, conducting layer 25 will form a secondary reflector for a Newtonian antenna system. In each case the axial dimension of body 20 is chosen to maintain a specified distance between the primary reflector and the secondary reflector.

Layers 15 and 25 can be foil, wire screen, electrically conducting plastic, woven, knit, or non-woven electrically conducting fabric, or any other electrically conducting material. They can be coats of electrically conducting paint on surface 11 of rear body 10 in FIG. 6, surface 18 and dome 23 of body 20, and depression 27 of cover 30. They can also be electrically conducting adhesives in the interstices between the mating reflector-forming surfaces of bodies 10 and 20 and cover 30.

The overall advantages of the invention include elimination of secondary-reflector support webs or spider legs, light weight, and simple form compatible with economical manufacture. Rear body 10, dielectric body 20, and cover 30 can be molded of light-weight low-dielectric foamed polymer materials at low cost. The molded foam components and the mating horn of an electromagnetic wave transmitting or receiving device fit together to place them at their required positions relative to each other. The components can be assembled rapidly with the required precision by unskilled labor.

This invention has been described in its presently contemplated best mode, with several alternatives. It is susceptible to numerous modifications, modes, and embodiments without the exercise of further invention.

I claim:

1. An antenna structure comprising a body composed of a rigid foam dielectric material having a dielectric constant approximately equal to that of air, having on one side, a first surface of revolution having the form of a primary reflector of an antenna system, on the same side, an axially symmetric protrusion extending outward from said first surface of revolution, having a peripheral surface having the form of a portion of the inner surface of a horn for transmitting or receiving microwave or millimeter wave electromagnetic radiation, the axis of said protrusion coinciding with an extension of the axis of said first surface of revolution, and on the opposite side, a second surface of revolution being formed as a dome-shaped protrusion or a bowl-shaped depression and having the form of a secondary reflector of an antenna system, its axis coinciding with an extension of the common axis of said first surface of revolution and said protrusion, layers of electrically conducting material in contact with said surfaces of revolution of said body and corresponding to the shape of said surfaces to form primary and secondary reflectors of an antenna system, and a horn associated with an electromagnetic wave transmitting device or an electromagnetic wave receiving device mating with said protrusion of said body, said body having an axial dimension that places said horn and said layers of electrically conducting material at positions relative to each other such that the assembly can function as an antenna reflector system for transmitting or receiving microwave or millimeter wave electromagnetic radiation.

2. The antenna structure of claim 1 wherein said layers of electrically conducting material are composed of metal foil.

3. The antenna structure of claim 1 wherein said layers of electrically conducting material are composed of fabrics of metal wires.

4. The antenna structure of claim 1 wherein said layers of electrically conducting material are composed of fabrics of electrically conducting yarns or threads.

5. The antenna structure of claim 1 wherein said layers of electrically conducting material are composed of an electrically conducting polymer.

6. The antenna structure of claim 1 wherein said layers of electrically conducting material are composed of an electrically conducting paint.

7. The antenna structure of claim 2 wherein said metal foil forming said primary reflector is sandwiched between said first surface of revolution of said foam body and a mating surface of a second foam body, and said metal foil forming said secondary reflector is sandwiched between said second surface of revolution of said foam body and a mating surface of a third foam body.

8. The antenna structure of claim 3 wherein said fabric of metal wires forming said primary reflector is sandwiched between said first surface of revolution of said foam body and a mating surface of a second foam body, and said fabric of metal wires forming said secondary reflector is sandwiched between said second surface of revolution of said foam body and a mating surface of a third foam body.

9. The antenna structure of claim 4 wherein said fabric of conductive yarns or threads forming said primary reflector is sandwiched between said first surface of revolution of said foam body and a mating surface of a second foam body, and said fabric of conductive yarns or threads forming said secondary reflector is sandwiched between said second surface of revolution of said foam body and a mating surface of a third foam body.

* * * * *